US008349250B2

(12) United States Patent
Suzuki et al.

(10) Patent No.: US 8,349,250 B2
(45) Date of Patent: Jan. 8, 2013

(54) COBALT-NICKEL SUPERALLOYS, AND RELATED ARTICLES

(75) Inventors: Akane Suzuki, Clifton Park, NY (US); Michael Francis Xavier Gigliotti, Jr., Scotia, NY (US)

(73) Assignee: General Electric Company, Niskayuna, NY (US)

( * ) Notice: Subject to any disclaimer, the term of this patent is extended or adjusted under 35 U.S.C. 154(b) by 517 days.

(21) Appl. No.: 12/465,821

(22) Filed: May 14, 2009

(65) Prior Publication Data

US 2010/0291406 A1 Nov. 18, 2010

(51) Int. Cl.
*C22C 19/05* (2006.01)

(52) U.S. Cl. ..... 420/450; 428/680; 416/241 B; 416/241 R; 420/448

(58) Field of Classification Search ..... 428/655, 428/668, 680; 148/408, 409, 410; 420/442, 420/445, 446, 447, 448, 450; 416/241 B, 416/241 R
See application file for complete search history.

(56) References Cited

U.S. PATENT DOCUMENTS 6,177,046 B1 * 1/2001 Simkovich et al. ..... 420/444
7,094,475 B2 * 8/2006 Schnell et al. ..... 428/678
2008/0185075 A1 8/2008 Ishida et al.
2008/0185078 A1 8/2008 Ishida et al.
2009/0087338 A1 * 4/2009 Mitchell et al. ..... 420/448

FOREIGN PATENT DOCUMENTS

EP 0237196 A1 9/1987
EP 1195446 * 4/2002

OTHER PUBLICATIONS

Frances, M., et al., Hot Corrosion Behavior of Low Pressure Plasma Sprayed NiCoCrAlY + Ta Coatings on Nickel Base Superalloys, J. Vac. Sci. Technology A. 3 (6), Nov./Dec. 1985.*
Ji-Cheng Zhao, "The Diffusion-Multiple Approach to Designing Alloys," Annu. Rev. Mater. Res., Jan. 21, 2005, vol. 35, pp. 51-73.
EP10162318 Search Report, August 25, 2010.

* cited by examiner

*Primary Examiner* — Jennifer McNeil
*Assistant Examiner* — Daniel J. Schleis
(74) *Attorney, Agent, or Firm* — Francis T. Coppa

(57) ABSTRACT

A cobalt-nickel alloy composition is described, containing about 20% to about 28% cobalt; about 37% to about 46% nickel; at least about 6% chromium; aluminum; and at least one refractory metal. The total weight of cobalt, aluminum, and refractory metal in the composition is less than about 50% of the total weight of the composition. Moreover, the alloy composition comprises both a (Co, Ni)-gamma phase and an $L1_2$-structured (gamma prime) phase. Various components made from the cobalt-nickel alloy composition are also described. Examples include high-temperature machinery and devices, e.g., components of gas turbine engines.

21 Claims, 2 Drawing Sheets

COBALT-NICKEL SUPERALLOYS, AND RELATED ARTICLES

BACKGROUND

This invention generally relates to metallic alloy compositions. More specifically, the invention relates to nickel/cobalt alloys useful for high temperature applications, and related articles.

Superalloys are often the materials of choice for components intended for high-temperature environments. (The term "superalloy" is usually intended to embrace complex cobalt- or nickel-based alloys which include one or more other elements such as aluminum (Al) and chromium (Cr)). As an example, turbine blades and other parts of turbine engines are often formed of nickel-based superalloys because they need to maintain their integrity at temperatures of at least about 1000-1150° C. The alloys can be formed by a variety of processes, such as conventional casting, unidirectional casting, and single crystal techniques. A number of treatment steps usually follow casting, such as "solid-solutioning", aging treatments, and precipitation-strengthening steps. The alloys may also be provided with an environmental protection coating.

The addition of various elements to the nickel (Ni) matrix results in the formation of the "$L1_2$"-structured phase, via a precipitation mechanism. As those in the art understand, the presence of the $L1_2$ phase provides greater strength to the alloy, at very high use temperatures. In fact, in many instances, the $L1_2$ phase exhibits an inverse temperature dependence, in which strength becomes higher with rising temperature.

The cobalt-based alloys are also of special interest for certain end uses. As an example, these alloys sometimes exhibit higher melting temperatures than their nickel counterparts. Depending on specific formulations, the cobalt (Co) alloys can also sometimes provide enhanced corrosion resistance in a variety of high-temperature environments which contain corrosive gases.

Up until recently, cobalt-based alloys which also include the desirable $L1_2$ phase appeared to be unavailable. However, in U.S. Patent Publication 2008/0185078, Ishida et al describe cobalt-based alloys with high heat resistance and strength, and which contain a precipitated $L1_2$ phase. The $L1_2$ phase in this instance is an intermetallic compound of the formula $Co_3(Al, W)$. While the alloy compositions in Ishida may contain a number of other elements, most of the compositions appear to be based on relatively large amounts of cobalt, aluminum, and tungsten.

Metallurgists understand that nickel and cobalt alloys used in demanding applications often require a very careful balance of properties. Just a few of these properties are mentioned here: strength (at high and medium temperatures), oxidation resistance, ductility, and corrosion resistance. Other properties and characteristics include "castability", weight, and cost. In highly demanding service environments, achieving a necessary balance between all of these properties represents an ever-increasing challenge to the alloy formulator.

Furthermore, manufacturing flexibility in preparing a desired alloy has become an important consideration in a commercial setting—especially in an era of high energy costs and raw material costs. While small alloy samples in the laboratory can be formulated and cast very precisely, that type of precision is often not attainable in a large, commercial foundry-type operation, where alloy melts and billets can weigh up to 20,000 pounds. If the cast alloy is found to be "off-spec" and inferior, e.g., due to a formulation error, it may have to be re-melted or scrapped. Either result can represent a serious production problem. Therefore, alloy formulations in which the levels of certain constituents can be changed to some degree, without adversely affecting the properties of the final casting, would be of considerable value in an industrial setting.

With these considerations in mind, new superalloy compositions would be welcome in the art. The alloys should exhibit a desirable combination of the properties noted above, such as environmental resistance and high-temperature strength. They should also exhibit good "manufacturability" characteristics, which can provide important commercial advantages in the industrial environment.

BRIEF DESCRIPTION OF THE INVENTION

A cobalt-nickel alloy composition is disclosed herein, comprising, by weight:

about 20% to about 28% cobalt;
about 37% to about 46% nickel;
at least about 6% chromium;
aluminum; and
at least one refractory metal.

The total weight of cobalt, aluminum, and refractory metal in the composition is less than about 50% of the total weight of the composition. Moreover, the alloy composition comprises both a (Co, Ni)-gamma phase and an $L1_2$-structured (gamma prime) phase.

Articles prepared, partly or entirely, from such compositions, represent another embodiment of the invention. Examples of such articles include high-temperature machinery and devices, e.g., components of gas turbine engines.

DETAILED DESCRIPTION OF THE INVENTION

Figure 1:
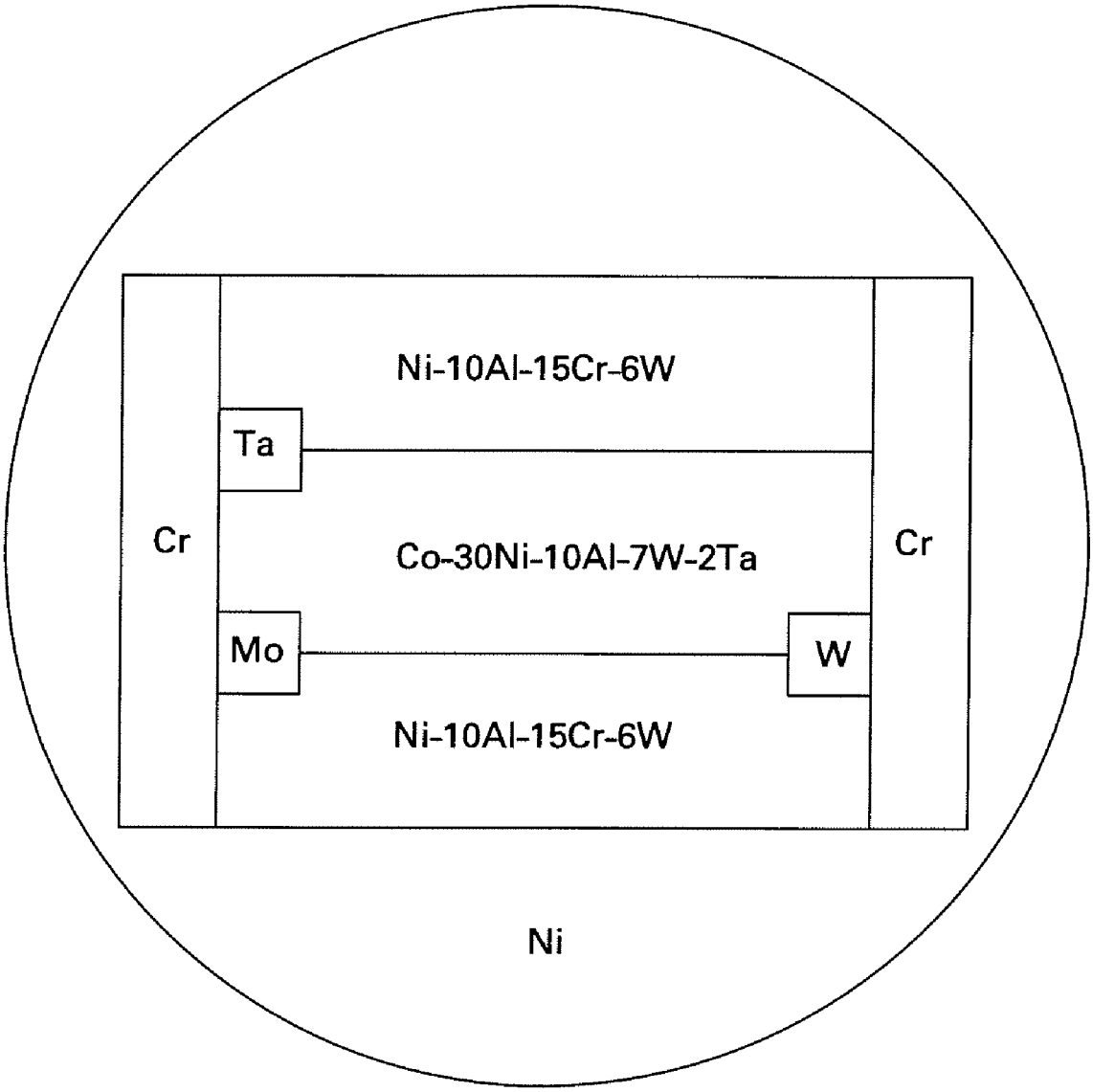
FIG. 1 is a depiction of a diffusion multiple test structure for nickel-cobalt alloy samples.

The compositional ranges disclosed herein are inclusive and combinable (e.g., ranges of "up to about 25 wt %", or, more specifically, "about 5 wt % to about 20 wt %", are inclusive of the endpoints and all intermediate values of the ranges). Weight levels are provided on the basis of the weight of the entire composition, unless otherwise specified; and ratios are also provided on a weight basis. Moreover, the term "combination" is inclusive of blends, mixtures, alloys, reaction products, and the like. Furthermore, the terms "first," "second," and the like, herein do not denote any order, quantity, or importance, but rather are used to distinguish one element from another. The terms "a" and "an" herein do not denote a limitation of quantity, but rather denote the presence of at least one of the referenced items. The modifier "about" used in connection with a quantity is inclusive of the stated value, and has the meaning dictated by context, (e.g., includes the degree of error associated with measurement of the particular quantity). The suffix "(s)" as used herein is intended to include both the singular and the plural of the term that it modifies, thereby including one or more of that term (e.g., "the refractory element(s)" may include one or more refractory elements). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described inventive features may be combined in any suitable manner in the various embodiments.

The alloy materials described herein may include, but are not limited to, materials provided as a wire, materials provided with an equiaxed microstructure (EA) or single-crystal structure, and materials provided with a directionally solidified (DS) microstructure. Material properties, as discussed herein, are determined under standard industrial tests at the specified conditions, unless otherwise specified. The material compositions set forth herein are provided in approximate weight percent, with weight determined on the basis of the total weight of the alloy, unless otherwise indicated.

The alloy composition of the present invention includes both cobalt and nickel. After some of the various processing steps described below, cobalt, nickel, and several other elements usually form a face-centered cubic (FCC) phase in the alloy. Such a phase is typically associated with nickel-containing superalloys, providing a strengthening mechanism, and is known in the art as the "gamma" (γ) phase.

The amount of cobalt in the alloy is in the range of about 20% by weight to about 28% by weight, and in some specific embodiments, about 21% by weight to about 28% by weight. In some embodiments which are especially preferred for specific end uses, the level of cobalt is within one of two ranges: about 21% by weight to about 23% by weight; or about 25% by weight to about 27% by weight.

The amount of nickel in the alloy is in the range of about 37% by weight to about 46% by weight, and in some specific embodiments, about 37% by weight to about 45% by weight. As in the case of cobalt, there are certain ranges which are especially preferred for specific end uses. In particular, there are two ranges for nickel which are of special interest: about 42% by weight to about 45%; and about 37% by weight to about 42% by weight. The most appropriate ranges for cobalt and nickel will depend in large part on the set of properties required for the particular end use; as well as various commercial factors. In some preferred embodiments, the ratio of nickel to cobalt is in the range of about 1.3 to about 2.1.

As noted previously, the alloy composition of this invention further includes chromium. Chromium is an important constituent for environmental resistance, e.g., resistance to "hot corrosion", mixed-gas attack, and mechanical damage, like erosion. Chromium can also be important for enhancing high temperature strength and oxidation resistance. In specific embodiments, the alloy composition comprises at least about 6% by weight chromium. In other preferred embodiments, the amount of chromium is at least about 9% by weight, and often, in the range of about 10% by weight to about 12%. As further discussed below, one of the special attributes of this invention is based on the discovery that the benefits of a specified, relatively high range of chromium can be obtained, while maintaining other critical properties which would typically be impacted in similar compositions of the prior art.

Aluminum is another important constituent for the alloys described herein. Like chromium, aluminum also provides oxidation resistance to the alloy. Moreover, for the presently-described alloys, aluminum forms important intermetallic compounds with the base metals, i.e., forming the $(Co, Ni)_3(Al, Z)$ gamma prime (γ') phase. As mentioned above, this phase is generally known as the $L1_2$phase, and functions as a very important high-temperature strength mechanism. As further described below, "Z" is meant to represent selected refractory metals. (The tungsten-containing phase, i.e, $(Co, Ni)_3(Al, W)$, is often preferred in many embodiments).

The amount of aluminum present will depend on a number of factors. They include the respective levels of Co, Ni, Cr, and refractory metal(s); as well as the environment in which the alloy will be used. In some specific embodiments, the amount of aluminum present is at least about 3% by weight, and more typically, at least about 4% by weight. The upper limit of aluminum is usually about 5%.

As mentioned above, the alloy composition includes at least one refractory metal. In general, the refractory metals improve the high-temperature hardness and high-temperature strength of the alloys. Moreover, they participate in the formation of the $L1_2$ phase. Suitable refractory metals include tungsten, molybdenum, tantalum, niobium, vanadium, and rhenium. Various combinations of these metals may also be present in the alloy. In general, the refractory metals are usually present at a level (total) of at least about 1% by weight, and more often, at least about 10% by weight, based on the weight of the entire composition. Total refractory element content is usually 30% or less by weight. In some preferred embodiments, the total amount of refractory metal is usually in the range of about 10% by weight to about 25% by weight.

In some specific embodiments, tungsten, tantalum, and molybdenum are the preferred refractory metals. Moreover, in some cases, it is preferred that at least about 50% of the total refractory metal content (by weight) comprises tungsten. (Tungsten is sometimes especially useful in the formation of the gamma prime phase, which provides strength to the alloy). A useful range for tungsten is often about 1% by weight to about 20% by weight, and in some specific embodiments, about 10% by weight to about 18% by weight. For some end use applications, the level of tungsten may be in the range of about 15% by weight to about 19% by weight.

The level of tantalum, if present, is usually in the range of about 0.1% by weight to about 5% by weight, and in some cases, about 2% by weight to about 4% by weight. The amount of molybdenum, when present, is typically in the range of about 0.1% by weight to about 15% by weight, and in some specific embodiments, about 1% by weight to about 10% by weight.

As mentioned above, another key feature for embodiments of this invention relates to the prescribed, collective level for cobalt, aluminum, and the refractory metal(s). The total weight should be less than about 50% of the weight of the composition. These reduced levels permit the addition of significant amounts of nickel. The increased levels of nickel, in turn, allow for relatively high levels of chromium to be added to the alloy system. As further described below, the addition of a "flexible" amount of chromium to similar alloy systems in the prior art was not possible if levels of other necessary properties were to be maintained. In those instances in which the alloy composition contains tungsten, some preferred embodiments call for a combined level of cobalt, aluminum, and tungsten to be less than about 45% by weight.

The alloy compositions of this invention can further comprise a number of other elements which impart properties suitable for certain end use applications. Non-limiting examples of such elements are carbon, silicon, boron, titanium, manganese, iron, and zirconium. The appropriate amount of each of these elements will depend on a variety of end use requirements.

As an example, boron, at levels up to its solubility limit, can be useful for improving high-temperature hardness and wear resistance, as well as strength. Carbon is sometimes useful, at selected levels, for combination with various other elements, such as chromium, tungsten, molybdenum, titanium, niobium, and the like, to form carbides. The carbides can also improve the hardness of the alloys under room temperature and high temperature conditions. Moreover, in selected amounts, silicon can be useful for improving the casting and welding characteristics of the alloy, as well as molten metal fluidity, and environmental resistance.

Titanium and zirconium, at selected levels, are often effective for stabilization of the gamma prime phase and the improvement of high-temperature strength. (Zirconium can also be useful in conjunction with boron, to strengthen grain boundaries). Moreover, manganese can be useful for improving weldability characteristics.

Non-limiting, exemplary ranges can be provided for these elements (when present), based on total weight % in the composition:

C: About 0.01 wt % to about 0.2 wt %;
Si: About 0.1 wt % to about 0.5 wt %;
B: About 0.01 wt % to about 0.6 wt %;
Ti: About 0.1 wt % to about 5 wt %;
Mn: About 0.1 wt % to about 5 wt %;
Fe: About 0.1 wt % to about 5 wt %;
Zr: About 0.1 wt % to about 1 wt %;

The alloy compositions for embodiments of this invention may further comprise at least one platinum group metal ("PGM"). This class includes ruthenium (Ru), rhodium (Rh), osmium (Os), iridium (Ir), platinum (Pt), and palladium (Pd). These platinum group metals can be used to enhance various properties such as ductility, fatigue resistance, and creep resistance. However, they are primarily used to improve oxidation resistance—often through formation of the $L1_2$-structured phase discussed previously. The presence of least one of ruthenium, rhodium, and iridium is sometimes especially preferred for some embodiments of the present invention.

The most appropriate amount of the platinum group metal (if present) will depend on many of the factors described herein. As an example, while there can be benefits in employing one or more of these elements at relatively small amounts, the addition of greater amounts, in some instances, may result in the formation of potentially-harmful alloy phases, such as a NiAl(PGM) phase.

Non-limiting, exemplary ranges can be provided for the PGM metals, based on total weight % in the composition:

Ru: About 0.1 wt % to about 30 wt %;
Rh: About 0.1 wt % to about 30 wt %;
Os: About 0.1 wt % to about 25 wt %;
Ir: About 0.1 wt % to about 25 wt %;
Pt: About 0.1 wt % to about 25 wt %;
Pd: About 0.1 wt % to about 30 wt %.

In most embodiments which contain platinum group metals, the total amount is in the range of about 0.1 wt % to about 5 wt %, based on the weight of the entire alloy composition, though other embodiments may call for greater amounts of specific PGM elements, within the ranges noted above. Moreover, it should be noted that some of the platinum group metals have densities which could add considerable weight to a part, e.g., a rotating turbine blade. Thus, in some embodiments, the total level of Pt, Ir, and Os, when present, should be at a level low enough to maintain the overall alloy density at less than about 10 g/cc. Usually, the total level of Pt, Ir, and Os would thus be less than about 25 wt %, based on the weight of the total alloy composition.

Those skilled in the art will appreciate that selections for particular levels of the alloy constituents described above are influenced by a number of factors. Thus, within the teachings of this disclosure, alloy formulators would usually consider the tradeoff between strength and ductility, as well as oxidation resistance. Other factors also play a part in this alloy "balance", e.g., economic factors (costs of raw materials), as well as material weights.

Those skilled in the art understand that minor amounts of other elements at impurity levels are inevitably present, e.g., in commercially-supplied alloys, or by way of processing techniques. Those impurity-level additions may also be considered as part of this invention, as long as they do not detract from the properties of the compositions described herein.

A specific alloy composition for some embodiments comprises the following constituents:

Co: About 21 wt % to about 28 wt %;
Ni: About 37 wt % to about 46 wt %;
Cr: About 6 wt % to about 12 wt %;
Al: About 3 wt % to about 5 wt %;
W: About 15 wt % to about 19 wt %; and
Ta: About 2 wt % to about 4 wt %;
with the total amount of Co, Al, and W being in the range of about 40 wt % to about 49.9 wt %, based on the weight of the entire alloy composition; and a Ni/Co ratio in the range of about 1.4 to about 2.1.

In some preferred embodiments, the alloy composition comprises the following constituents:

Co: About 21 wt % to about 28 wt %;
Ni: About 37 wt % to about 46 wt %;
Cr: About 9 wt % to about 12 wt %;
Al: About 3 wt % to about 5 wt %;
W: About 15 wt % to about 19 wt %; and
Ta: About 2 wt % to about 4 wt %;
with the total amount of Co, Al, and W being in the range of 40 wt % to about 49.9 wt %; and
a Ni/Co ratio in the range of about 1.4 to about 2.1.

The alloy compositions of this invention can be prepared by way of any of the various traditional methods of metal production and forming. Traditional casting, powder metallurgical processing, directional solidification, and single-crystal solidification are non-limiting examples of methods suitable for forming ingots of these alloys. Thermal and thermo-mechanical processing techniques common in the art for the formation of other alloys are suitable for use in manufacturing and strengthening the alloys of the present invention. Various details regarding processing techniques and alloy heat treatments are available from many sources. Non-limiting examples include U.S. Pat. No. 6,623,692 (Jackson et al) and U.S. Patent Publication 2008/0185078 (Ishida et al), both of which are incorporated herein by reference. Moreover, various forging and machining techniques could be used to shape and cut articles formed from the alloy composition.

In some embodiments, the alloy compositions can be formed into a pre-determined shape, and then subjected to a solution treatment, followed by an aging treatment. In the aging treatment, the alloy is typically heated in a temperature range of about 500° C. to about 1100° C. (preferably about 800° C. to about 1100° C.), in order to precipitate the desired phase, e.g., $(Co, Ni)_3(Al, Z)$, where Z is at least one refractory metal. As described above, $(Co, Ni)_3(Al, Z)$ is the "$L1_2$"-structured phase for the alloy, which provides some of its important attributes. (Depending on the overall formulation, the "$L1_2$"-structured phase may contain some of the other elements discussed previously, such as chromium).

The cobalt-nickel alloys of this invention can be formed into many shapes and articles, e.g., plates, bars, wire, rods, sheets, and the like. As alluded to previously, the attributes of these alloys make them especially suitable for high temperature articles. Examples include various parts for aeronautical turbines, land-based turbines, and marine turbines. Specific, non-limiting examples of the components include vanes, blades, buckets, stators, and combustor sections.

In another aspect of this invention, the cobalt-nickel superalloys could be used to protect other articles or alloy structures. As an example, a layer of the alloy composition can be attached or otherwise formed on another alloy structure or part which requires properties characteristic of this alloy composition, e.g., environmental resistance and high temperature strength. (The underlying substrate could be formed of a variety of metals and metal alloys, e.g., iron, steel alloys, or other nickel- or cobalt-alloys). The overall product could be considered a composite structure, or an "alloy cladding" over a base metal or base metal core. Bonding of the cladding layer to the underlying substrate could be carried out by conventional methods, such as diffusion bonding, hot isostatic pressing, or brazing. Moreover, those skilled in the art would be able to select the most appropriate thickness of the cladding layer, for a given end use, based in part on the teachings herein.

EXAMPLES

The example presented below is intended to be merely illustrative, and should not be construed to be any sort of limitation on the scope of the claimed invention.

A diffusion multiple technique was used in this example, as generally described in "The Diffusion-Multiple Approach to Designing Alloys", by Ji-Cheng Zhao, Annu. Rev. Mater. Res. 2005, 35, pp. 51-73; and in "Mapping of the Nb—Ti—Si Phase diagram using Diffusion Multiples", by Ji-Cheng Zhao et al, Materials Science and Engineering A 372 (2004) 21-27. Both articles are incorporated herein by reference. The diffusion multiple consists of two or more sections of metals or alloys in close, interfacial contact with each other, so as to allow thermal interdiffusion after selected heat treatments. In this manner, composition gradients and intermetallic compounds are formed, which permit the mapping of composition-phase-property relationships.

For this example, high-purity samples for a number of elements (e.g., Ni, Al, Cr, W, Co, Ta) were used to form "pieces" or "blocks". The blocks were machined into desired shapes for joining, by electro-discharge machining (EDM). The height of each of the pieces was 34 mm, and the other dimensions varied according to shape. The re-cast layer on the machined surface for each piece was removed by mechanical grinding, to make clean surfaces. The alloy pieces were ultrasonically cleaned in methanol, and then assembled into a selected geometry. FIG. 1 depicts one such geometry for some of the various pieces. (Percentages are shown for the alloy composition. The various element symbols without percentages indicate the pure metals). A number of other samples with different compositional blocks and different block geometries were also assembled, to support the profile for FIG. 2, discussed below.

Each diffusion multiple sample was then loaded into a hot isostatic press (HIP) can, which was formed from commercial-purity nickel. The top and bottom caps of the HIP can were electron beam welded-shut.

An initial HIP treatment was then carried out at 1250° C., 276 MPa, for 6 hours, which initiated the composition gradient between the different blocks. The HIP can containing the diffusion multiples was then encapsulated in the evacuated quartz tube, which was back-filled with pure argon. A second heat treatment was then carried out for 1 week at 1250° C. A third heat treatment was carried out for 100 hours at 1000° C. in an evacuated quartz tube, which was back-filled with pure argon. The third heat treatment was sufficient to result in the formation of the $L1_2$phase in a number of the samples.

After the samples were removed from the heat-treatment containers, the pieces were detached, and the surfaces were again polished. The surfaces were then examined closely under a microscope. The presence of the $L1_2$phase, as well as other alloy characteristics, was examined. Special attention was paid to examining the double- and triple-junction areas where the various pieces had been in intimate contact with each other. The presence of the $L1_2$ phase was examined by scanning microscopy, and compositional analysis was conducted by electron microprobe analysis. Compositional analysis was used to plot the points on the graph of FIG. 2.

Figure 2:
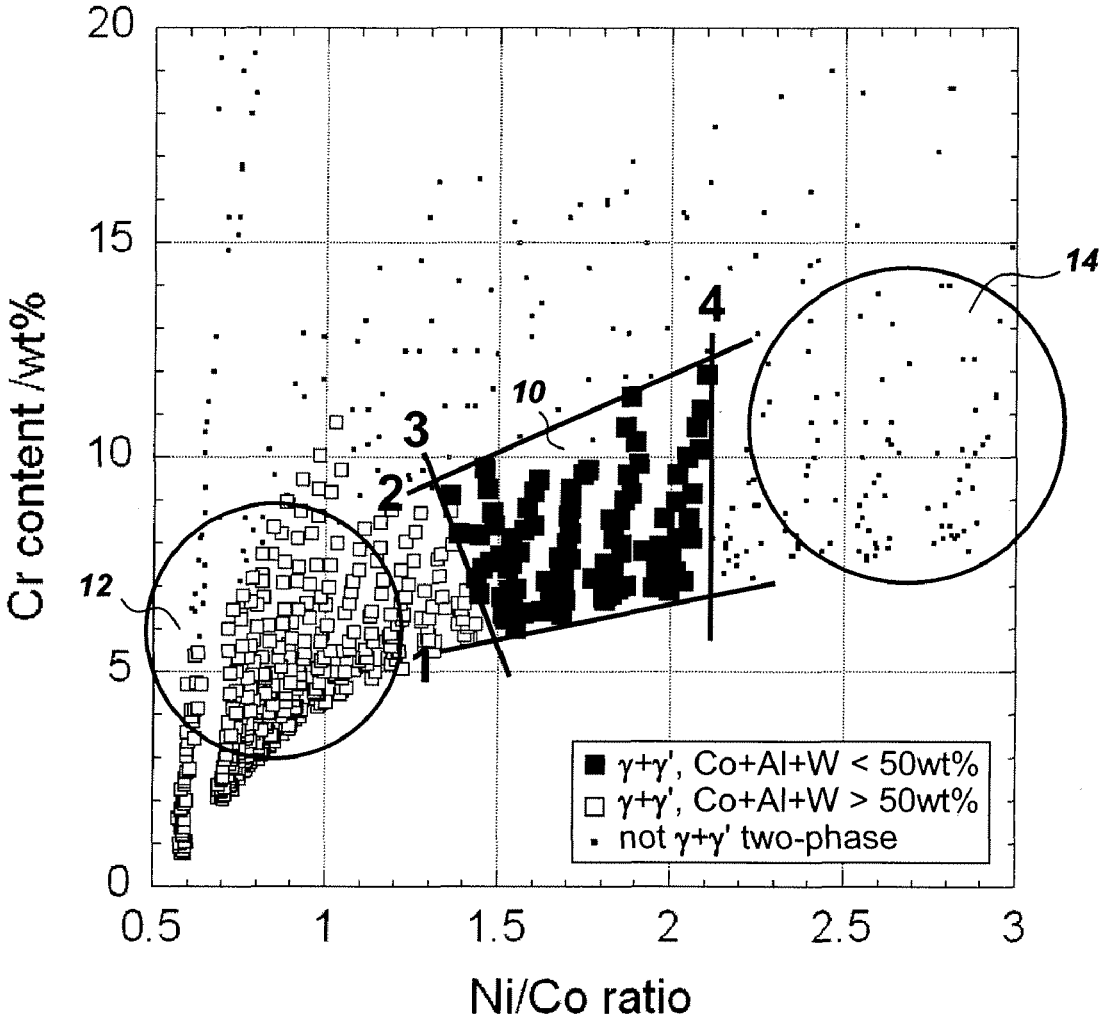
FIG. 2 is a graph depicting various alloy samples, based on chromium content as a function of the ratio between nickel and cobalt in the alloy.

FIG. 2 is a graph which effectively depicts the results obtained by applying the diffusion-multiple technique for the selected alloy samples. The figure plots chromium content in the samples, as a function of the ratio between nickel and cobalt. The present inventors discovered that a particular region within the wide range of samples provides alloys with desirably-high levels of chromium, while maintaining other important properties, such as corrosion- and oxidation-resistance. Alloy samples of the prior art do not appear to exhibit these characteristics over as wide a range of chromium concentration.

Cobalt-nickel alloys within the scope of this invention can be described by an equation which represents the quadrilateral region 10 in FIG. 2. Thus, these compositions are generally defined with reference to the formula $$\text{Wt \% Cr}=A_1(\text{Ni/Cr})+B_1,$$

with the following boundary lines:

line 1: $A_1=1.77$ $B_1=3.06$
line 2: $A_2=3.65$ $B_2=4.59$
line 3: $A_3=-23.73$ $B_3=41.08$
line 4: Ni/Cr=2.124

Outside of region 10 in FIG. 2, there are samples which, though useful for some purposes in the art, may be deficient in a number of different ways—via properties or via compositional flexibility. As an example, most of the samples in region 12 (with approximate boundaries indicated), with nickel/cobalt ratios less than about 1.3, may contain sufficient levels of the gamma prime phase, but may exhibit other drawbacks. A primary deficiency relates to chromium levels. For example, those samples cannot generally accommodate relatively high levels of chromium, without causing the formation of undesirable phases. Examples include chromium-rich phases which precipitate in plate-like or needle-like structures, and which can be deleterious to alloy mechanical properties. The chromium level can be controlled to minimize the formation of such phases, but then corrosion resistance and oxidation resistance may suffer.

Moreover, most of the samples in region 14 (with approximate boundaries indicated) may be deficient in other respects. For example, many of the samples may not contain sufficient amounts of the gamma prime phase. Some of the samples in region 14 may also include the presence of harmful chromium-rich phases, discussed previously.

In some embodiments, a particular region within the boundaries of region 10 is preferred. This region includes cobalt-nickel compositions which are also characterized by relatively high chromium content, e.g., at least about 9% by weight. The general boundary lines for this region (Wt % $\text{Cr}=A_1(\text{Ni/Cr})+B_1$) are as follows, with chromium at a level of about 9% by weight to about 12% by weight:

line 2: $A_2=3.65$ $B_2=4.59$
line 3: $A_3=-23.73$ $B_3=41.08$
line 4: Ni/Cr=2.124

The present invention has been described in terms of some specific embodiments. They are intended for illustration only, and should not be construed as being limiting in any way. Thus, it should be understood that modifications can be made thereto, which are within the scope of the invention and the appended claims. Furthermore, all of the patents, patent applications, articles, and texts which are mentioned above are incorporated herein by reference.

The invention claimed is:

1. A cobalt-nickel alloy composition, comprising, by weight:

about 20% to about 28% cobalt;

about 37% to about 46% nickel;

at least about 6% chromium;

aluminum; and about 10% by weight to about 18% by weight tungsten;

wherein the total weight of cobalt, aluminum, and tungsten is less than about 50% of the total weight of the composition; and wherein the alloy comprises both a (Co, Ni)-gamma phase and an $L1_2$-structured (gamma prime) phase.

2. The alloy composition of claim 1, comprising at least one additional refractory metal is selected from the group consisting of molybdenum, tantalum, niobium, rhenium, vanadium, and combinations thereof.

3. The alloy composition of claim 2, wherein at least about 50 weight % of the total refractory metal content comprises tungsten.

4. The alloy composition of claim 1, wherein the amount of chromium present is at least about 9%.

5. The alloy composition of claim 1, wherein the amount of chromium present is in the range of about 9% to about 12%.

6. The alloy composition of claim 1, wherein the amount of cobalt present is in the range of about 21% to about 28%.

7. The alloy composition of claim 1, wherein the amount of nickel is in the range of about 37% to about 42%.

8. The alloy composition of claim 1, wherein the amount of nickel is in the range of about 42% to about 45%.

9. The alloy composition of claim 1, wherein the amount of aluminum present is at least about 3%.

10. The alloy composition of claim 9, wherein the amount of aluminum present is in the range of about 3% to about 5%.

11. The alloy composition of claim 1, comprising about 0.1% to about 5% tantalum.

12. The alloy composition of claim 1, comprising about 0.1% to about 15% molybdenum.

13. The alloy composition of claim 1, further comprising at least one element selected from the group consisting of carbon, silicon, boron, titanium, manganese, iron, and zirconium.

14. The alloy composition of 1, further comprising at least one platinum group metal selected from ruthenium, rhodium, osmium, iridium, platinum, and palladium.

15. The alloy composition of claim 14, wherein the total amount of platinum group metal present is in the range of about 0.1 wt % to about 5 wt %, based on the weight of the entire composition.

16. The alloy composition of claim 1, wherein the total amount of cobalt, aluminum, and tungsten is less than about 45% of the total weight of the composition.

17. The alloy composition of claim 1, in the form of a plate, bar, wire, rod, or sheet.

18. A cast article, comprising the cobalt-nickel alloy composition of claim 1.

19. A gas turbine engine component, comprising an alloy composition which itself comprises:

about 20% to about 28% cobalt;

about 37% to about 46% nickel;

at least about 6% chromium;

aluminum; and about 10% by weight to about 18% by weight tungsten;

wherein the total weight of cobalt, aluminum, and tungsten is less than about 50% of the total weight of the composition; and wherein the alloy comprises both a (Co, Ni)-gamma phase and an $L1_2$-structured (gamma prime) phase.

20. An article, comprising a) a substrate which comprises a metal or metal alloy; and b) a cladding bonded to at least a portion of the substrate, wherein the cladding comprises a cobalt-nickel alloy composition, comprising, by weight:

about 20% to about 28% cobalt;

about 37% to about 46% nickel;

at least about 6% chromium;

aluminum; and about 10% by weight to about 18% by weight tungsten;

wherein the total weight of cobalt, aluminum, and tungsten in the cladding is less than about 50% of the total weight of the composition; and wherein the cladding alloy comprises both a (Co, Ni)-gamma phase and an $L1_2$-structured (gamma prime) phase.

21. The article of claim 20, wherein the substrate is a component of a turbine engine.

* * * * *